United States Patent [19]

Shiota

[11] Patent Number: 4,798,489

[45] Date of Patent: Jan. 17, 1989

[54] INK RIBBON CONTROL APPARATUS FOR LOCATING REPLACEMENT CARTRIDGE COLOR BAND IN A COLOR PRINTER

[75] Inventor: Keiichi Shiota, Tokyo, Japan

[73] Assignee: Kabushiki Kaisha Toshiba, Kawasaki, Japan

[21] Appl. No.: 899,593

[22] Filed: Aug. 25, 1986

[30] Foreign Application Priority Data

Aug. 29, 1985 [JP] Japan ..... 60-190311

[51] Int. Cl.[4] ..... B41J 35/16

[52] U.S. Cl. ..... 400/216.1; 400/196.1; 400/212; 400/240; 400/240.4; 400/249

[58] Field of Search ..... 400/194, 195, 196, 196.1, 400/207, 208, 208.1, 212, 216, 240, 240.4, 249, 693.1

[56] References Cited

U.S. PATENT DOCUMENTS

| | | | |
|---|---|---|---|
| 3,223,219 | 12/1965 | Cappotto et al. | 400/693.1 X |
| 4,407,593 | 10/1983 | Haftmann | 400/208 |
| 4,425,046 | 1/1984 | Van Horne et al. | 400/208 |
| 4,511,903 | 4/1985 | Miyazaki et al. | 400/208 X |
| 4,563,100 | 1/1986 | Hamamichi | 400/216.1 X |
| 4,586,837 | 5/1986 | Johnson et al. | 400/208 X |
| 4,589,785 | 5/1986 | Sato | 400/61 |

FOREIGN PATENT DOCUMENTS

| | | | |
|---|---|---|---|
| 0179682 | 10/1983 | Japan | 400/208 |
| 0093376 | 5/1984 | Japan | 400/249 |
| 0120488 | 7/1984 | Japan | 400/249 |

OTHER PUBLICATIONS

IBM Technical Disclosure Bulletin, "Ribbon-Sensitivity Adjustment", Cassidy et al, vol. 24, No. 12, May 1982, pp. 6541-6542.

IBM Technical Disclosure Bulletin, "End-of-Ribbon Sensor and Cartridge-Present Indicator", Jenkins, vol. 27, No. 6, Nov. 1984, pp. 3645-3647.

*Primary Examiner*—Ernest T. Wright, Jr.

*Attorney, Agent, or Firm*—Finnegan, Henderson, Farabow, Garrett, & Dunner

[57] ABSTRACT

A ribbon control apparatus for a color printer has a cartridge holder to be installed with a ribbon cartridge supporting a color ribbon which has four color bands aligned to the lateral direction of the color ribbon, a carriage for supporting the holder movably in the lateral direction of the ribbon, and a drive section for driving the holder. The control apparatus further has a first detecting switch for detecting that the cartridge is disposed at an initial position, and a second detecting switch for detecting that the cartridge is exchanged. The drive section responds to a detection signal from the second switch to move the cartridge toward the initial position when the cartridge is exchanged, and responds to a detection signal from the first switch to tilt the cartridge to locate a previously selected color band of the ribbon relative to the printing head consistent with the location of the previous cartridge prior to its replacement.

9 Claims, 3 Drawing Sheets

INK RIBBON CONTROL APPARATUS FOR LOCATING REPLACEMENT CARTRIDGE COLOR BAND IN A COLOR PRINTER

BACKGROUND OF THE INVENTION

The present invention relates to an ink ribbon control apparatus and, more particularly, to an ink ribbon control apparatus for a color printer which uses a ribbon cartridge associated with a multicolor ink ribbon for printing.

Color printers are used considerably, for example, for the output terminal of a computer. A color ink ribbon is laterally divided into a plurality of color bands, which are different colors. One end of the ribbon is bonded to the other end to form an endless loop, and is contained in a ribbon cartridge. The cartridge has an inlet and an outlet for the ribbon so that parts of the loop are bridged between the inlet and the outlet. The cartridge is inserted into the printer so that the bridged portion is disposed between a platen and a printing head. In a color printer of serial dot type, the ink ribbon slides a predetermined length between the inlet and the outlet whenever the head performs printing by means of ink on the ribbon. The cartridge is moved in an upward or downward direction to select the color of the character. In other words, the color band of the desired color is opposed to the head by this movement of the cartridge. The head prints a character by hitting the band with printing wires.

The above-mentioned printer generally sets the cartridge to an initial position in response to an initialize signal upon turning of a power source of the printer to ON or from a signal from a host computer, and then moves the cartridge upward from the initial position to oppose the color band of the color of the character to be printed to the head.

The cartridge being used might sometimes need to be replaced with a new ribbon cartridge because the color of the printed characters has become too light. However, when a cartridge is exchanged in a conventional printer, the new cartridge is set at an installed position in the rest area under the initial position. Depending upon the inserting pressure of the cartridge into the printer this rest position is different at every insertion. In the conventional printer, the printing operation is restarted in this state after the cartridge is exchanged. Thus, the character may not printed by the desired color. For example, after the printing is restarted, the front end of the head might be set at the intermediate between two color bands, and the character is printed with mixed colors in this case.

SUMMARY OF THE INVENTION

An object of the present invention is to provide an ink ribbon control apparatus for a color printer which permits accurate initializing of a ribbon cartridge in case of inserting the cartridge into the printer to print a character without mixed colors in case of exchanging the cartridge midway through the printing operation.

According to the present invention, there is provided an ink ribbon control apparatus for a color printer comprising a supporting unit for supporting a ribbon cartridge movably in the lateral direction of a color ink ribbon which is supported by said ribbon cartridge and divided into a plurality of color bands in the lateral direction, a first detecting switch for generating a first detection signal when the ribbon cartridge is disposed at an initial position, a second detecting switch for generating a second detection signal when the cartridge is replaced, and a drive unit for driving the supporting unit in response to the second detection signal to move the cartridge toward the initial position and driving the supporting unit in response to the first detection signal to further move the cartridge at a distance required to set the color band designated before replacing the cartridge to a predetermined printing position with the initial position as a reference.

DETAILED DESCRIPTION OF THE PREFERRED EMBODIMENTS

Figure 1:
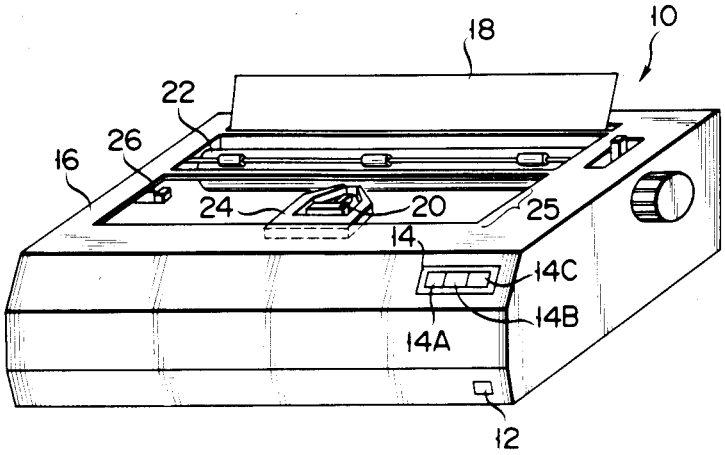
FIG. 1 is a view as seen from the exterior of a color printer of an embodiment according to the present invention.

An embodiment of the present invention will be described with reference to FIGS. 1 to 5. FIG. 1 shows the schematic structure of color printer 10. Printer 10 is connected, for example, to a host computer 80 FIG. 5. The computer 80 supplies character and graphic data to printer 10. Printer 10 further prints a character under the control of the computer 80. This control, for example, designates the color of the character.

Printer 10 has power switch 12 and control panel 14 at the front end of cabinet 16. Test button 14A, feed button 14B and on-line switch 14C are provided on the control panel 14. Button 14A is used to test printer 10. Button 14B is used to permit printer 10 to perform a line feed operation in off line. Switch 14C is used to allow the control by the computer 80. Printer 10 further has paper support 18 for feeding a paper 57 to platen 22, and printing head 20 fixed to a carriage 32 (see FIG. 3) which reciprocates in a direction parallel to platen 22. Ribbon cartridge 24 is detachably inserted onto the carriage 32. In FIG. 1, head 20 and cartridge 24 are exposed for easy observation and concealed by a cover plate (not shown) openably mounted in opening 25 on the upper surface of cabinet 16 during use. This plate is opened, for example, at the time of exchanging cartridge 24 or of cleaning head 20. The state of the plate is detected by cover switch 26.

Figure 2:
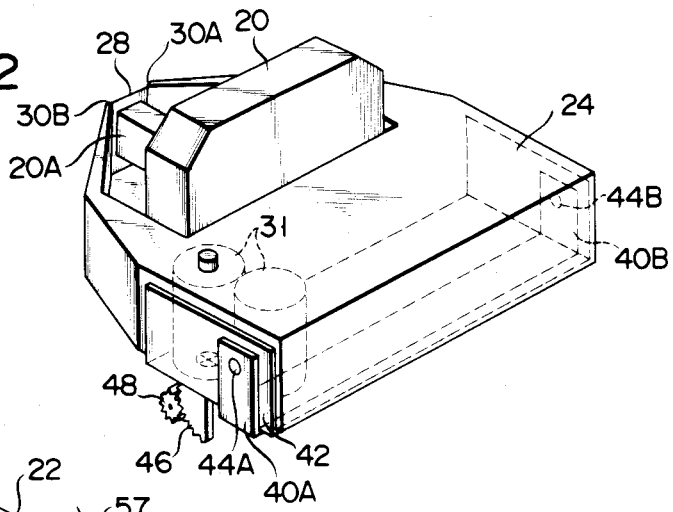
FIG. 2 is a view of a ribbon cartridge to be inserted into the color printer of FIG. 1 in detail.

FIG. 2 is a view for describing in more detail cartridge 24. Cartridge 24 has a shape capable of surrounding head 20 as shown in FIG. 2, and contains color ink ribbon 28. The ends of ribbon 28 are connected to form an endless loop. The cartridge 24 has outlet portion 30A and inlet portion 30B for ink ribbon 28, and part of ribbon 28 is bridged between inlet portion 30B and outlet portion 30A. The bridged portion of ribbon 28 is interposed between front end 20A of head 20 and platen 22 when cartridge 24 is inserted onto carriage 32 of printer 10. Front end 20A contains a plurality of printing wires (not shown) that are selectively projected into ribbon 28 to transfer the ink from ribbon 28 onto the printing medium or sheet 57. The bridged portion of ribbon 28 is intaken into inlet portion 30B and led out from outlet portion 30A in the length corresponding to the intake by the rotation of rollers 31 provided in cartridge 24 .

Figure 3:
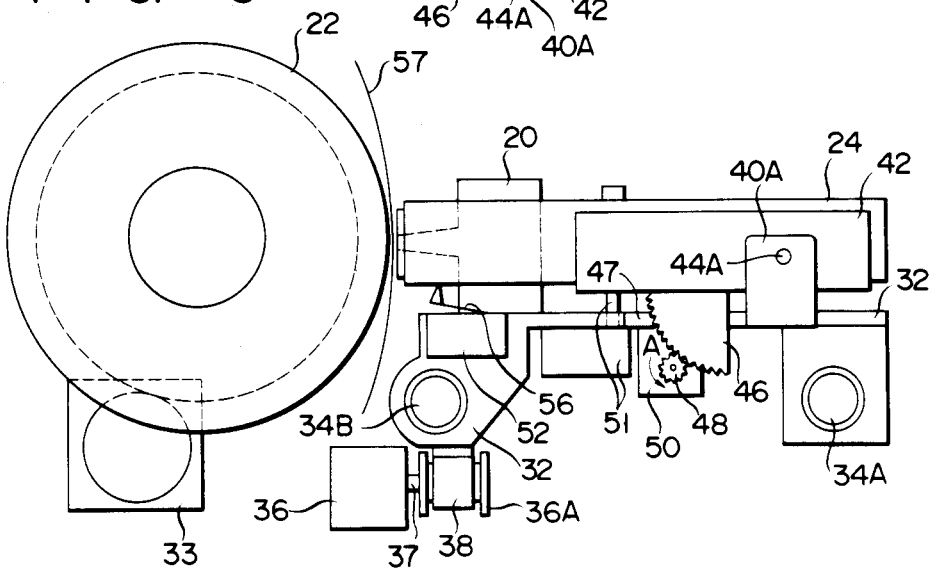
FIG. 3 is a view showing ribbon cartridge holding and angle regulating mechanism shown in FIG. 2.

FIG. 3 shows a mechanism for holding cartridge 24 and regulating an angle of cartridge 24. Printer 10 has carriage 32, platen roll motor 33 for rotating platen 22, carriage rails 34A and 34B extending in parallel with platen 22, and carriage motor 36 mounted near one end of rail 34B. Motor 36 is composed, for example, of a stepping motor, and gear 36A is fixed to its rotational shaft 37. Gear 36A is coupled, through timing belt 38, with a sprocket gear (not shown) mounted near the other end of rail 34B. Part of belt 38 is bonded to carriage 32. Carriage 32 is slidably mounted on rails 34A and 34B, and moved in forward and backward directions under the control motor 36. Carriage 32 has side walls 40A and 40B, and cartridge holder 42 is inserted between walls 40A and 40B. Holder 42 is supported by shafts 44A and 44B repsectively fixed to walls 40A and 40B. The angle of holder 42 can vary at shafts 44A and 44B as a center. Rack gear 46 is connected to the lower surface of holder 42 as shown in FIG. 3. Carriage 32 has a notch 47 at the portion corresponding to the projection of rack gear 46 so as not to disturb the variation in the angle holder 42. The toothed portion of rack gear 46 is engaged in mesh with pinion gear 48. Gear 48 is fixed to the rotational shaft of angle control motor 50 mounted on the lower surface of carriage 32. Motor 50 is composed, for example, of a stepping motor. Cartridge 24 is inserted onto holder 42 at using time. In FIG. 3, when gear 48 rotates clockwise, the bridged portion of ribbon 28 is moved downward. On the other hand, when gear 48 rotates counterclockwise, the bridge portion of ribbon 28 is moved upward. One of rollers 31 of cartridge 24 is connected to rotating mechanism 51 mounted on carriage 32 at the inserting time to rotate as carriage 32 slides.

Printer 10 further has position switch 52 mounted at the side of carriage 32. Switch 52 has actuating rod 56 which projects above carriage 32. Rod 56 self-holds its projecting state, and is pressed down by the pressure from cartridge 24. Switch 52 is turned ON and OFF by the movements of rod 56. A print sheet 57 is inserted between cartridge 24 and platen 22.

Figure 4:
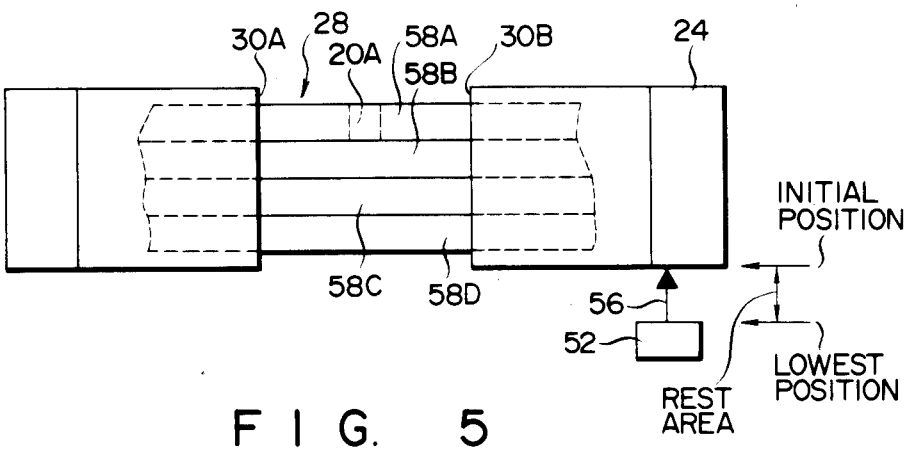
FIG. 4 is a view showing a positional relationship between a multicolor ink ribbon and a printing head in FIG, 2.

FIG. 4 shows the positional relationship between ink ribbon 28 and head 20. Ribbon 28 is divided laterally into a plurality, for example, four, of color bands 58A, 58B, 58C, 58D, which are respectively impregnated with black, cyan, magenta, and yellow ink. When cartridge 24 is inserted onto holder 42, the front end of cartridge 24 (e.g., outlet 30A and inlet 30B) is set in the rest area under the initial position shown in FIG. 4. When front end 20A of head 20 is opposed to uppermost band 58A as shown in FIG. 4, the front end of cartridge 24 is at the initial position. Bands 58A to 58D of ribbon 28 are selected after the front end of cartridge 24 is moved from the rest area to the initial position.

Switch 52 is kept in the OFF state before cartridge 24 is installed. When cartridge 24 is installed, the front end of cartridge 24 is pressed down. Switch 52 is kept in the ON state while the cartridge 24 is disposed at or lower than the initial position. Switch 52 is again turned OFF when the front end of cartridge 24 is moved above the initial position and when cartridge 24 is released from holder 42.

Figure 5:
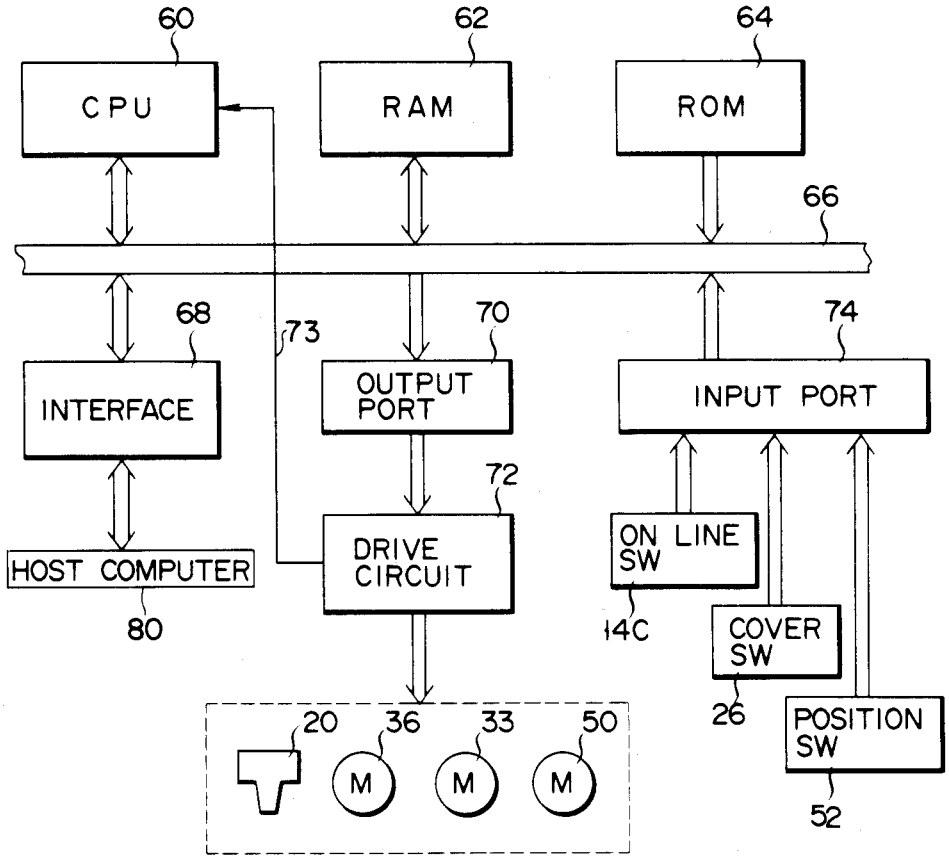
FIG. 5 shows a control circuit for controlling the mechanism of FIG. 3.

FIG. 5 schematically shows the control circuit of color printer 10. The control circuit has CPU 60, RAM 62, ROM 64, and bus 66. The control program of printer 10 is stored in ROM 64. CPU 60 reads out and executes the commands of the program sequentially from ROM 64. RAM 62 stores necessary data such as character codes, printing commands supplied, for example, from a host computer 80 through interface 68 when executing the commands. ROM 64 stores in advance character pattern data corresponding to predetermined character codes. When character data is supplied from host computer 80, CPU 60 reads out the corresponding character pattern data from ROM 64 to form data necessary for printing. CPU 60 further controls drive circuit 72 through output port 70. Drive circuit 72 selectively drives head 20, carriage motor 36, platen roll motor 33 and angle control motor 50 under the control of CPU 60. The rotating steps of the respective motors 36, 33, and 50 are determined by the number of pulses generated from drive circuit 72. CPU 60 refers signals supplied from on-line switch 14C, cover switch 26, and position switch 52 through input port 74 to control drive circuit 72. Drive circuit 72 is connected to CPU 60 through line 73 to notify that angle control motor 50 has completed the predetermined rotation.

Figure 6A:
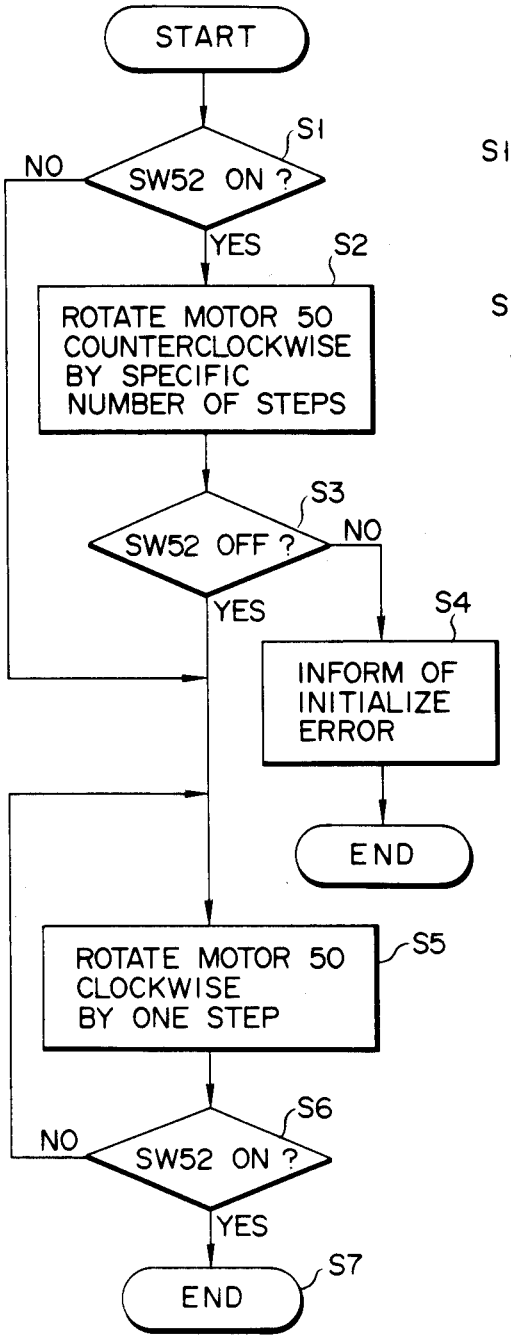
FIGS. 6A and 6B are flowcharts for describing the operation of the control circuit of FIG. 5.

The operation of the color printer 10 will be described with reference to FIGS. 6A and 6B. When power switch 12 is depressed in the condition that cartridge 24 is seated in holder 42, an initialize routine shown in FIG. 6A is executed in order to initialize the position of cartridge 24. CPU 60 checks whether position switch 52 is ON or not in this routine in step S1. If yes, CPU 60 controls drive circuit 72 in step S2. Drive circuit 72 drives angle control motor 50 so that pinion gear 48 rotates at an angle of predetermined steps counterclockwise as shown by an arrow A in FIG. 3 by this control. The angle of holder 42 varies by the rotation of pinion gear 48, and the front end of cartridge 24 is moved upward. If no malfunction occurs in the printer 10, the front end of cartridge 24 passes the initial position before the rotation of pinion gear 48 is completed, thereby turning OFF position switch 52. CPU 60 waits for the information that the rotation of pinion gear 48 is completed from drive curcuit 72 in step S3, and checks whether position switch 52 is OFF or not after receiving the information. If no, CPU 60 notifies an error status to the host computer 80 through interface 68 in step S4.

If no in step S1 and yes in step S3, CPU 60 executes steps S5. CPU 60 control drive circuit 72 in step S5 to rotate pinion gear 48 at an angle of one step. CPU 60 then checks whether position switch 52 is ON or not in step S6. If no, CPU 60 executes step S5, while if yes, CPU 60 writes in RAM 62 data representing that cartridge 24 is set to the initial position, i.e., that front end 20A is opposed to band 58A and step S7, and ends the process. Printer 10 completes the printing preparation in this state.

When on-line switch 14C is depressed, printer 10 becomes an on line state for approving control by host computer 80. When a color designation command is supplied to printer 10, CPU 60 writes in RAM 62 data representing the color band of the designated color, and controls drive circuit 72. Under the control, drive circuit 72 rotates angle control motor 50 and pinion gear 48 the necessary number of steps with the initial position as a reference to oppose the corresponding color band 58A–58D to front end 20A of head 20.

CPU 60 sequentially converts character data supplied from the host computer 80 into the corresponding character pattern data, and allows head 20 to print the character pattern corresponding to the data. In this printing, a plurality of printing wires (not shown) are selectively projected from front end 20A toward platen 22 to mark sheet 57 with the ink of the color band 58A-58D opposed to front end 20A. Drive circuit 72 rotates carriage motor 36 and platen roll motor 33 by the control of CPU 60 before printing the respective characters in order to alter the positions of the characters to be printed.

When the necessity of exchanging the cartridge 24 arises during printing, the printer cover is opened or on-line switch 14C is pressed. Cover switch 26 notifies CPU 60 when the cover is opened. CPU 60 releases the on line state to interrupt the printing in response to a signal from cover switch 26 or on-line switch 14C. Then, cartridge 24 is replaced with a new one. When new cartridge 24 is inserted onto holder 42, the front end of cartridge 24 is set to an installed position in the rest area under the initial position.

Figure 6B:
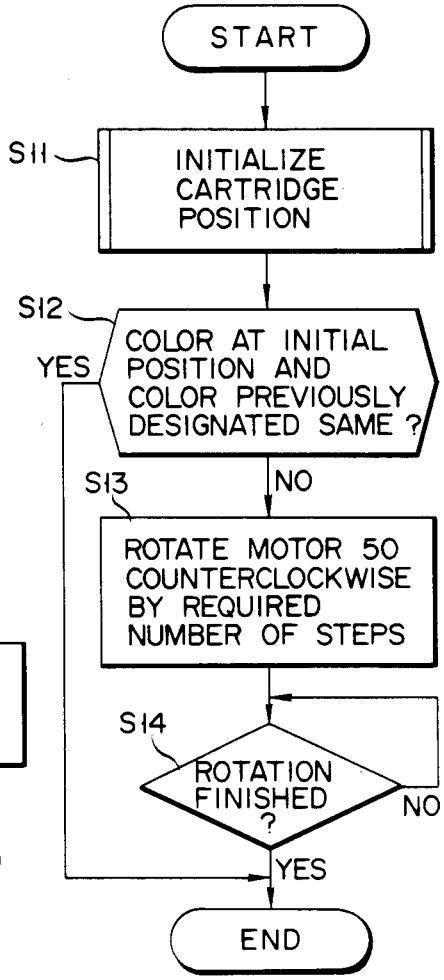

Then, when the cover is closed or on-line switch 14C is pressed, CPU 60 regards it as the completion of replacing cartridge 24 and executes a restore routine shown in FIG. 6B. The position of cartridge 24 may be returned to the position immediately before exchanging the cartridge 24. CPU 60 performs the same processes as those in step S1 to S6 of the above-mentioned initializing routine in step S11 of the restore routine. CPU 60 reads out data representing the position of cartridge 24 immediately before exchanging the cartridge 24 in step S12 from RAM 62, and checks whether or not the data represents the same position as that of the initial position. If no, CPU 60 controls drive circuit 72 to rotate angle control motor 50 and pinion gear 48 at an angle of predetermined steps in the direction of arrow A in FIG. 3 in step S13, locating a previously selected color band 58A-58D of the ribbon at the same position, relative to the printing head 20, as the color band 58A-58D of the previous cartridge 24 was placed prior to replacement. CPU 60 waits the completion of the rotation of angle control motor 50 in step S14, and finishes the execution of the restore routine after receiving the notice from drive circuit 72. If yes in step S12, CPU 60 finishes the execution of the restore routine similarly. Then, printer 10 notifies the return of on line state to the host computer 80, and restarts the printing operation.

According to the embodiment, the position of cartridge 24 is set to the initial position not only after the power source is turned ON but also after cartridge 24 is exchanged. Cartridge 24 is moved from the initial position to the desired position before the printing is restarted. Thus, even if new cartridge 24 is set to any position in the rest area, the character can be reliably printed in the same color as that before exchanging.

According to the present invention, the printing operation is prevented from restarting when a new cartridge is placed in an installed position in the rest area. Further, the new cartridge is moved a desired distance from the initial position so that a previously selected color band is opposed to the printing head. Thus, it can prevent the front end of the printing head from opposing two adjacent color bands. Therefore, the character to be printed is not printed with mixed colors, nor printed in the different colors from those before exchanging of the cartridge.

What is claimed is:

1. An ink ribbon control apparatus for a color printer of the type that has a printing head and uses a ribbon cartridge having housed therein an ink ribbon divided in a lateral direction into a plurality of color bands, the control apparatus comprising:

supporting means for supporting the ribbon cartridge, said supporting means permitting selective movement of the ribbon cartridge in the lateral direction of the ink ribbon;

detecting means for generating a first detection signal indicating that the ribbon cartridge is disposed at an initial position which serves as a reference position for changing the color bands and a second detection signal indicating that the ribbon cartridge has been replaced; and drive means, responsive to said detecting means, for driving said supporting means to move the ribbon cartridge in response to the first and second detection signals, said drive means moving the ribbon cartridge toward the initial position in response to the second detection signal and moving the ribbon cartridge by a required distance in response to the first detection signal to set a previously selected color band at the same position relative to the printing head of the printer as the color band of the previous ribbon cartridge prior to cartridge replacement.

2. An ink ribbon control apparatus according to claim 1, wherein said supporting means includes a cartridge holder for supporting the ribbon cartridge and a carriage for supporting said cartridge holder movably in the lateral direction of the ink ribbon.

3. An ink ribbon control apparatus according to claim 2, wherein said drive means includes a drive motor coupled to shift said cartridge holder in the lateral direction of the ink ribbon and a control circuit for controlling said drive motor in response to the first and second detection signals.

4. An ink ribbon control apparatus according to claim 3, wherein said control circuit includes a motor controller for rotating said drive motor in a predetermined direction from when the first detection signal is supplied to when the second detection signal is supplied and rotating said drive motor further in a predetermined amount from when the second detection signal is supplied.

5. An ink ribbon control apparatus according to claim 4, wherein said detecting means includes a position switch mounted on said carriage, said position switch generating the first detection signal when the ribbon cartridge is disposed at the initial position.

6. An ink ribbon control apparatus according to claim 5, wherein the printer includes a cabinet having a coverable opening providing access to the ribbon cartridge, and said detecting means includes a cover switch which generates the second detection signal in response to the covering of the opening of the cabinet.

7. An ink ribbon control apparatus according to claim 6, wherein said detecting means also includes an on line switch which generates the second detection signal at the time when the printer is connected to a host computer.

8. An ink ribbon control apparatus according to claim 3, wherein said drive means further includes a rack gear fixed to said cartridge holder and a pinion gear which is engaged in mesh with the rack gear and driven by said drive motor.

9. An ink ribbon control apparatus according to claim 1, wherein a predetermined one of the color bands of the ink ribbon is opposed to the printing head when the ribbon cartridge is disposed at the initial position.

* * * * *